US006105324A

United States Patent [19]

Krusec et al.

[11] Patent Number: 6,105,324

[45] **Date of Patent: *Aug. 22, 2000**

[54] FOLDABLE ROOF PANEL UNIT AND METHOD OF INSTALLATION

[75] Inventors: Edward R. Krusec, Woodstock; Kimberly M. Larson, Powder Springs, both of Ga.

[73] Assignee: Atlas Roofing Corporation, Meridian, Miss.

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 09/304,826

[22] Filed: May 5, 1999

Related U.S. Application Data

[63] Continuation of application No. 08/956,449, Oct. 23, 1997, Pat. No. 5,966,883.

[51] Int. Cl.[7] ..... E04D 13/04; E04D 13/16

[52] U.S. Cl. ..... 52/302.1; 52/71; 52/90.2; 52/309.4; 52/309.8

[58] Field of Search ..... 52/66, 70, 71, 52/90.2, 91.1, 90.1, 645, 408, 409, 309.4, 309.8, 302.1, 13, 198

[56] References Cited

U.S. PATENT DOCUMENTS

| | | | |
|---|---|---|---|
| 388,424 | 8/1888 | Lindblad | 52/70 |
| 3,346,998 | 10/1967 | Nelson | 52/70 |
| 3,562,973 | 2/1971 | Gangemi | 52/71 |
| 4,014,145 | 3/1977 | Groves . | |
| 4,503,644 | 3/1985 | Coutu, Sr. . | |
| 4,530,193 | 7/1985 | Ochs | 52/408 |
| 4,608,791 | 9/1986 | McClure . | |
| 4,642,950 | 2/1987 | Kelly | 52/90.2 |
| 4,681,481 | 7/1987 | Kapusta . | |
| 4,719,723 | 1/1988 | Van Wagoner | 52/309.4 X |
| 5,140,789 | 8/1992 | De Gooyer | 52/71 |
| 5,222,337 | 6/1993 | Thomsen et al. . | |
| 5,373,669 | 12/1994 | Paquette . | |
| 5,433,050 | 7/1995 | Wilson et al. . | |
| 5,660,004 | 8/1997 | Blackmon et al. . | |
| 5,663,882 | 9/1997 | Douglas . | |
| 5,966,883 | 10/1999 | Krusec et al. | 52/302.1 |

FOREIGN PATENT DOCUMENTS

| | | | |
|---|---|---|---|
| 2301655 | 9/1976 | France | 52/90.1 |
| 1509131 | 3/1969 | Germany . | |
| 506667 | 6/1971 | Switzerland | 52/71 |

OTHER PUBLICATIONS

NRG Barriers Brochure, "Tapered Pre–Cut Cricket", May 1996.

Apache Products Company Brochure, "Cricket Installation Instructions".

*Primary Examiner*—Laura A. Callo
*Attorney, Agent, or Firm*—Nixon & Vanderhye, P.C.

[57] ABSTRACT

A panel unit for roof drainage comprises plural panel sections with adjoining ones of the plural panel sections connected to be foldably collapsed on one another into a storage (e.g., transport) unit. In one embodiment, the panel sections are connected together for folding, e.g., by a hinge. Roofing saddles and roofing crickets of the present invention are formed using one or more sets of panel units. Sets of panel units are fabricated to have essentially the same footprint on the roof, although a lastly installed one of the sets of panel units is modified on site. A method of installing a roofing saddle comprised of the panel units is also provided.

19 Claims, 14 Drawing Sheets

FOLDABLE ROOF PANEL UNIT AND METHOD OF INSTALLATION

This is a continuation of application Ser. No. 08/956,449, filed Oct. 23, 1997, now U.S. Pat. No. 5,966,883.

BACKGROUND

1. Field of the Invention

The present invention pertains to method and apparatus for draining flat-roofed or low-slope roofed structures, and particularly to panels used for such purposes.

2. Related Art and Other Considerations

Since the beginning of "flat roof" building construction, it has been recognized that stagnant ponds of water are harmful. When water is left standing on any type of waterproof membrane,it accelerates the aging process of the membrane in that area. Accordingly, any place frequently covered by residual water left from a rain or snow melt will experience early failure.

Many schemes have been developed over the years to eliminate residual water ponds from what is now known as "low-slope roofing." For example, U.S. Pat. No. 4,014,145 to Groves teaches the art of using "roof saddles" to assist in eliminating standing water. As used herein, a roof saddle is a flat-bottomed pyramid which has an essentially elongated diamond-shaped bottom and a central peak or vertex on its top surface. Four surfaces of the saddle sloping down from the central vertex serve to allow water to run off the saddle for collection in drains provided in the roof. Drainage systems comprised of drain pipes and roof saddles have been the preferred method of eliminating residual water from essentially flat roofs for many years.

On very large roof expanses, building designers have often planned on the structural portion of the roof decks being built as a series of minor (low slope) pyramids to provide high centers and low valleys. A drain pipe was installed at each confluence of four valleys. Unfortunately, all too often the valley between two structural pyramids would become a pond for standing water. The typical solution usually is the utilization of roof saddles in the valleys to eliminate residual water.

Over the years, many methods have been employed to create and install roof saddles. Historically, the most frequently used method has been that of the roofing contractor forming saddles at the building site from low-cost fiber board or expanded polystyrene plastic foam. This on-site method is very slow and labor intensive.

As building construction contractors strive to finish their buildings faster in order to reduce costs, the "hand-made, on-the-job" method has become less favored. Rather, in order to reduce escalating labor costs, roofing contractors have increasingly turned to "pre-fabricated" saddles. Pre-fabricated saddles are custom made at a factory purportedly for speeding up the installation process.

Unfortunately, several problems arise utilizing the pre-fabricated method. For example, conventional "factory-made" roof saddles also turn out to be labor-intensive processes. Moreover, although factory labor tends to be lower in cost than construction labor, pre-fabricated roof saddle systems are also relatively expensive. In addition there is the problem of factory lead time. That is, a long lead time for factory orders (e.g., eight weeks) is inconsistent with the fast-track building approach employed by many building system managers. These managers desire to order and receive their material in just a few weeks. Therefore, transferring a labor-intensive process from the construction site to the factory does little to help the problem.

Ostensibly to reduce the labor costs inherent with pre-fabricated roof saddle systems, a method and apparatus for fabricating roofing saddles by computer-controlled machinery is taught in U.S. Pat. No. 5,663,882 to Douglas. While such computerized systems do reduce the cost of manufacturing pre-formed saddles, other problems are not addressed and some problems are spawned.

In computerized systems, the saddle components are built precisely to the length and width dimensions given in the architects' drawings. However, at the construction site, it is often necessary to make expedient changes. For example, for various reasons the roof configuration at the building site may not turn out to be strictly in accordance with the architectural drawings. For example, it frequently turns out that the drainage pipes have been moved in order to accommodate changes of the more important structural components of the building. In fact, in some cases the drainage pipes must be moved several feet in order to accommodate other newly added, or changed, building components. In such cases, the precisely manufactured conventional saddle diamonds are either too short or too long and thus will not form the drainage low-point at the drain pipe. Rather, a pre-fabricated saddle installed in an altered structure could either cover the drain pipe, or could instead form a low point several feet short of the drain. In either case, the precisely made conventional saddle is useless until extensive field cutting and repairs are made. Any cost or time saving otherwise attributable to a pre-fabricated conventional saddle is more than offset by having to modify such a precut saddle system when the saddle was made to architectural dimensions rather than actual building measurements.

Another problem with conventional pre-fabricated roofing saddles is the complexity (and thus cost) of the equipment required for computer controlled cutting and labeling. For conventional pre-fabricated saddles, an infinite variety of angles may be required. The requirement for widely varying angles contributes to the complexity of the saddle-fabricating machinery, and also to the frequency of repairs of such machinery.

Furthermore, saddles produced by conventional pre-fabricated saddle production systems have proved difficult to install, even when the actual structure matches the design drawings. In industry practice, the materials are shipped in a stretch-wrapped bundle approximating a four-foot cube. This package is comprised of many small pieces, as well as odd-shaped medium sized and large pieces. The smaller pieces are fragile and thus susceptible to being easily damaged. Also, as mentioned above, an infinite variety of angles are cut to accommodate any given roof shape. A system of labeling is required so that the installer can determine not only which pieces abut each other, but which edges of each piece must be joined. Many hours can be exhausted searching for the correct pieces to join, then matching the proper edges. If two packages are opened at the same time, the pieces can become intermixed, thus increasing the time spent to sort things out. If a breeze starts up, which is often the case on a rooftop, the smaller pieces can become lost. Thus, working with conventional pre-fabricated saddles transported in the plastic-wrapped cubes somewhat resembles solving an expensive jigsaw puzzle. Even with a complex labeling system, finding the correct pieces to join can become a challenge.

What is needed therefore, and an object of the present invention, is a roofing drainage panel unit which is inexpensive yet easy to fabricate, transport, and install.

SUMMARY OF THE INVENTION

The present invention provides a panel unit for a roofing drainage system as well as an installation method. The panel unit comprises plural panel sections with neighboring ones of the plural panel sections connected to be foldably collapsed on one another into a storage (e.g., transport) configuration. In one embodiment, the panel sections are connected together for folding by a flexible material which forms a hinge.

One embodiment of the panel unit has three panel sections. First and second adjacent ones of the panel sections are hingedly connected on top surfaces thereof, while second and third adjacent ones of the panel sections are hingedly connected on bottom surfaces thereof, thereby providing an essentially fan-fold configuration.

One or more panel units of the invention can be assembled to form various shaped drainage structures, including a roofing saddle or (alternatively) a structure less than pyramid shape (e.g., a cricket). Two mirror image panel units of the invention constitute a set. All sets of panel units are fabricated to have essentially the same footprint on the roof, although lastly installed ones of the sets of panel units are modified on site.

Vertically tapering ones of the panel units according to the invention are employed to provide a sloping drainage surface. Vertically tapering panel units can be formed of differing thickness. That is, vertically tapering panel units of adjacent sets but differing thickness can be juxtaposed to provide a continuously sloping surface.

Some panel units of the present invention are flat rather than vertically tapered. Flat panel units provide a base upon which vertically tapering panel units can be stacked. A stack comprising a tapered panel unit upon a flat panel unit can be juxtaposed with other panel units to extend the continuously sloping drainage surface past the manufactured thickness of the vertically tapered panels.

Advantageously, all panel units of the present invention at the same fixed angle. In one embodiment of the invention, the fixed angle is 18.43494882 degrees.

A method of installing a roofing saddle on a roof begins with determining a center line (e.g. "valley line") between first and second drains on the roof as well as a perpendicular bisector of the center line. Then, at least panel sections of a first set (e.g., thinnest panel units) of vertically tapering panel units are placed along the center line with the most narrow tips respectively placed at the edges of the first drain and the second drain. Any further needed sets of the vertically tapering panel units are placed on the center line abutting a preceding set of panel units. If needed to provide vertical height, the vertically tapering panel units can be mounted upon flat panel units. A last of the sets of panel units is modified so that the panel sections of the last panel units form the vertex above the perpendicular bisector.

In the method of the invention, panel sections arrive at the job site pre-folded in their shipping configuration. Once placed on the roof, the panel units are easily unfolded upon the area where required.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

In the following description, for purposes of explanation and not limitation, specific details are set forth such as particular architectures, techniques, etc. in order to provide a thorough understanding of the present invention. However, it will be apparent to those skilled in the art that the present invention may be practiced in other embodiments that depart from these specific details. In other instances, detailed descriptions of well known devices and methods are omitted so as not to obscure the description of the present invention with unnecessary detail.

Figure 1:
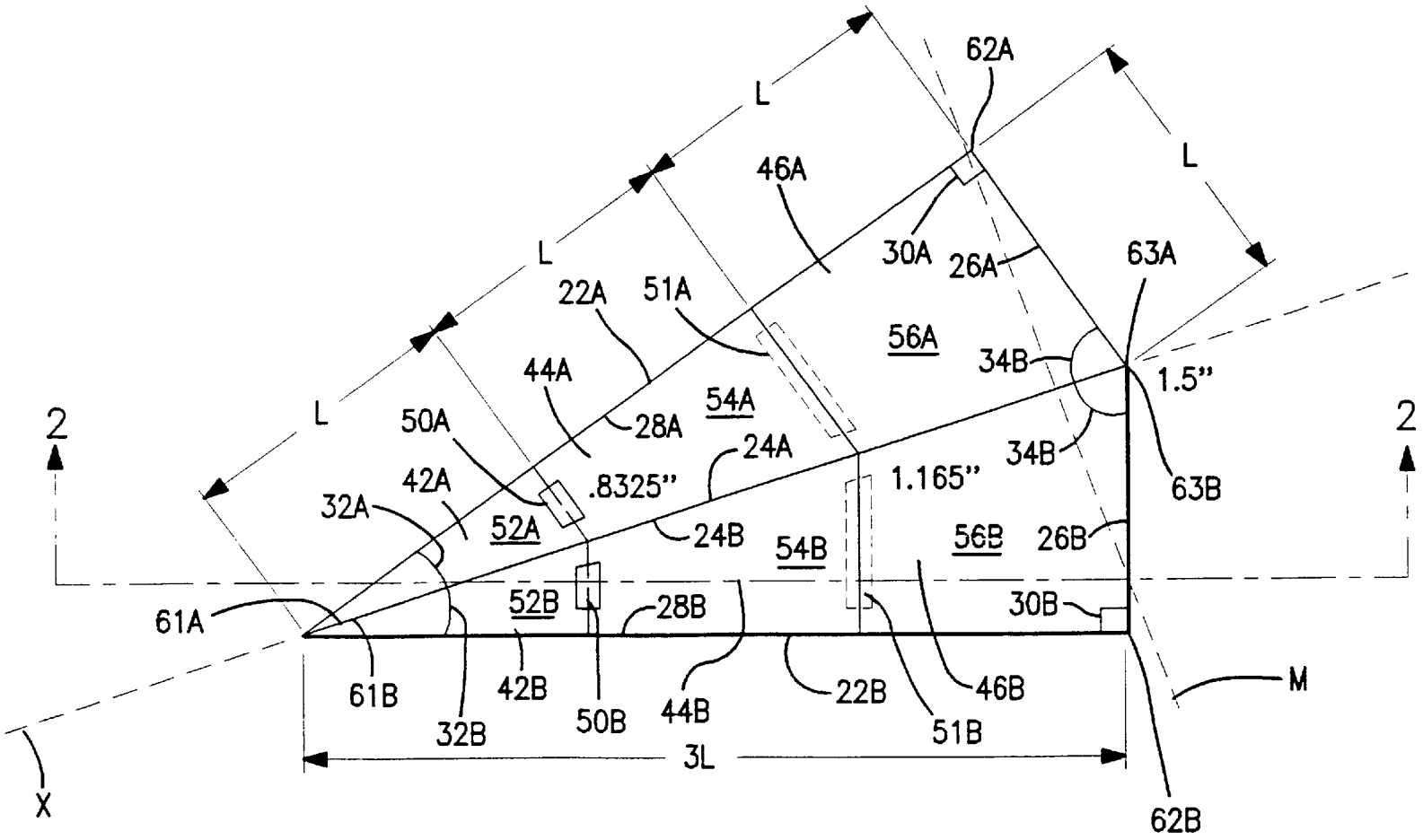
FIG. 1 is a top view of two adjacent vertically tapering panel units according to an embodiment of the present invention.

FIG. 1 shows two adjacent vertically tapering panel units 22A and 22B, laid side-by-side and seen from above. Each panel unit, generically referred to as panel unit 22, has the shape of a right triangle as seen from above with hypotenuse edge 24, minor edge 26, major edge 28, right angle 30, minor angle 32, and major angle 34. For example, panel unit 22A has hypotenuse edge 24A, minor edge 26A, major edge 28A, right angle 30, minor angle 32A, and major angle 34A. The two adjacent panel units 22A and 22B are situated with their hypotenuse edges 24A, 24B being contiguously aligned along their length.

Each panel unit 22 has three panel sections 42, 44, and 46. For example, panel unit 22A has panel sections 42A, 44A, and 46A. The length of each panel section 42, 44, 46 along major edge 28 of panel unit 22 is "L", whereby the total length of panel unit 22 along its major edge 28 is "3L". The length of minor edge 26 of each panel unit 22 is also "L". In the preferred embodiment, "L" is four feet (i.e, forty eight inches).

For each panel unit 22, panel section 44 is hinged to panel section 42 and panel section 46 is hinged to panel section 44. In particular, for each panel unit 22, panel section 44 is hinged to panel section 42 by a first hinge 50 provided at a top of panel unit 22; panel section 46 is hinged to panel section 44 by a second hinge 51 provided at a bottom of panel unit 22.

Figure 2:
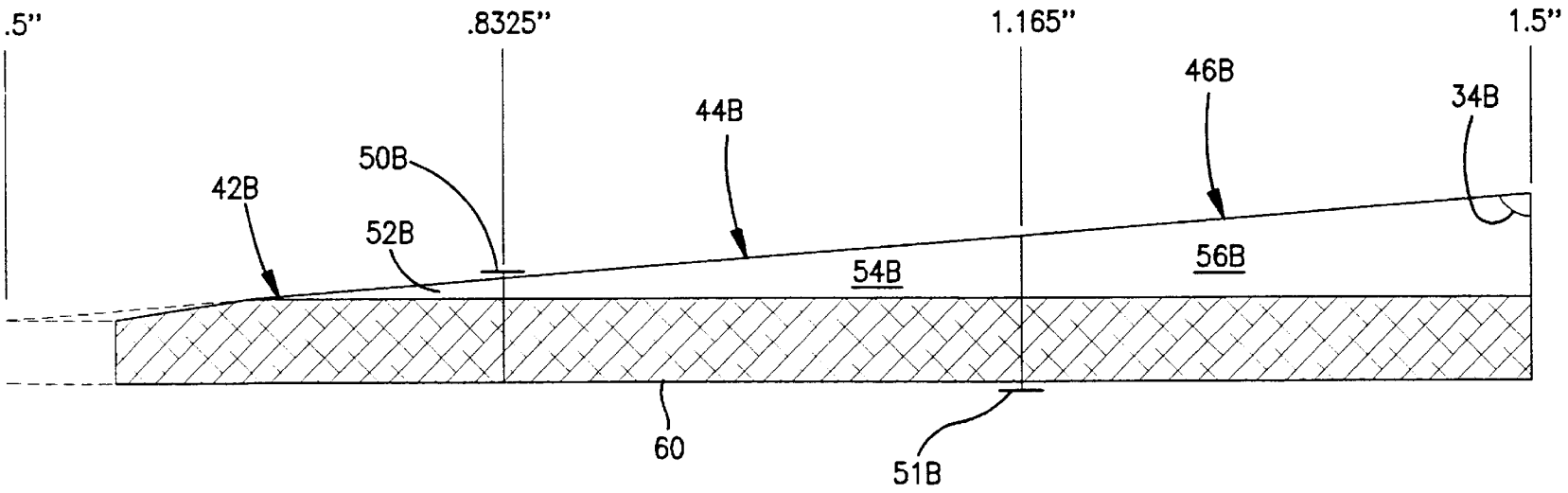
FIG. 2 is a sectioned side view taken along line 2—2 of FIG. 1.

As is understood from the sectioned side view of FIG. 2, each panel unit 22 has an essentially flat bottom 60. On the top side of panel unit 22, vertices 61 and 62 (see FIG. 1) which form endpoints of major edge 28 are at substantially the same elevation (the lowest elevation on the top side), while vertex 63 is at the highest elevation of panel unit 22. As shown in FIG. 1, the top side of each panel unit 22 has three top surfaces 52, 54, and 56, corresponding to each of panel sections 42, 44, and 46, respectively. As such, panel unit 22 is said to be vertically tapered (e.g. sloping in the Z direction). The panel units illustrated and described herein have a taper or slope of ¼ inch in the Z direction per foot of extent in the X-Y plane. It should be understood that in differing tapers or slopes are provided in other embodiments, such as (for example) ½ inch slope per foot.

The panel units of the present invention can be formed from any suitable material, such as (for example), cellular glass insulation, rigid fiberglass insulation, cellulose fiber board, mineral fiber board, expanded polystyrene board, extruded polystyrene board, and laminated polyisocyanurate board.

Hinges 50, 51 of the present invention are preferably formed by a flexible material which connects adjoining panel sections. For example, hinge 50B can be a segment of material which extends over the boundary of top surfaces 52B and 54B of panel sections 42B and 44B, respectively (see FIG. 1). Similarly, hinge 51B is a segment of material which extends over the boundary of bottom surfaces of panel sections 44B and 46B, respectively. In one embodiment, the flexible material can be adhesive tape.

Other examples of flexible material that can be used for hinges include duct tape and the heavy felt facer used on polyisocyanurate foam board. The heavy felt can be glued with insoluble contact adhesive or a two-part thermosetting adhesive such as epoxy. The use of hot melt adhesive is not practical as it will dissolve in hot asphalt. Other flexible materials that can be used are heavy Kraft paper, plastic film or pseudo leather such as Naugahyde, leather, multi-substance synthetic fiber tapes, either woven or non-woven and composite tapes with or without adhesive pre-applied.

Figure 3:
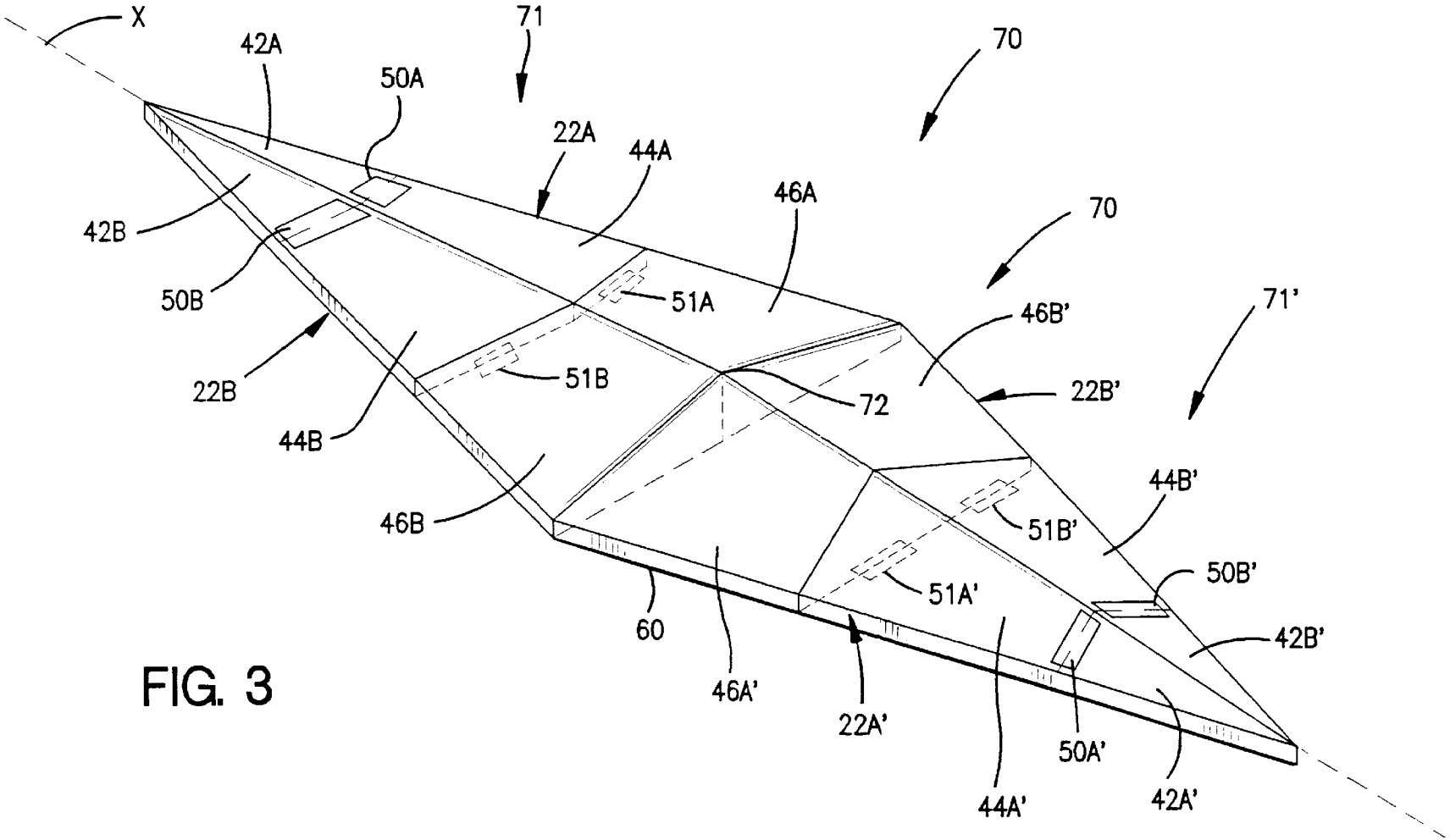
FIG. 3 is a top perspective view of a one stage roofing saddle utilizing four panel units of FIG. 1.

An assembled one-stage roofing saddle 70 of the invention comprising four panel units 22A–22D (which have been modified for installation) is shown in FIG. 3. As assembled, roofing saddle 70 is a pyramid having an essentially elongated (in the sense of axis X) diamond-shaped bottom. As mentioned above, assembled roofing saddle 70 has flat bottom 60 and four sloping top surfaces, each respectively formed by one of panel units 22A–22D. After modification, the four panel units 22A–22D meet at vertex 72.

In order to form the one stage roofing saddle 70 of FIG. 3, panel units 22A–22B must be cut along line M as shown in FIG. 1. When so cut, a panel unit is said to be "modified". Modification is necessary to have four panel units meet at a vertex. Thus, typically only four panel units of a roofing saddle need be modified. A method of the invention for assembling a roofing saddle including a modification step is described further below.

The one stage roofing saddle 70 of FIG. 3 comprises two identical sets 71, 71' of panel units. Each set includes both a right panel unit and a left panel unit. In this regard, set 71 includes a right panel unit, such as panel unit 22B, and a left panel unit, such as panel unit 22A. Set 71' is identical to set 71, but positioned to be a is mirror image thereof. Set 71 includes panel unit 22B' (which is identical to panel unit 22B) and panel unit 22A' (which is identical to panel unit 22A).

The present invention encompasses crickets and saddles formed from varying numbers of panel units of the present invention. Although it has been common historically to speak of saddles and crickets interchangeably, as used herein one or more panel units of the present invention assembled to form a drain structure less than a saddle (e.g., less than a full pyramid) is termed a "cricket."

Figure 4:
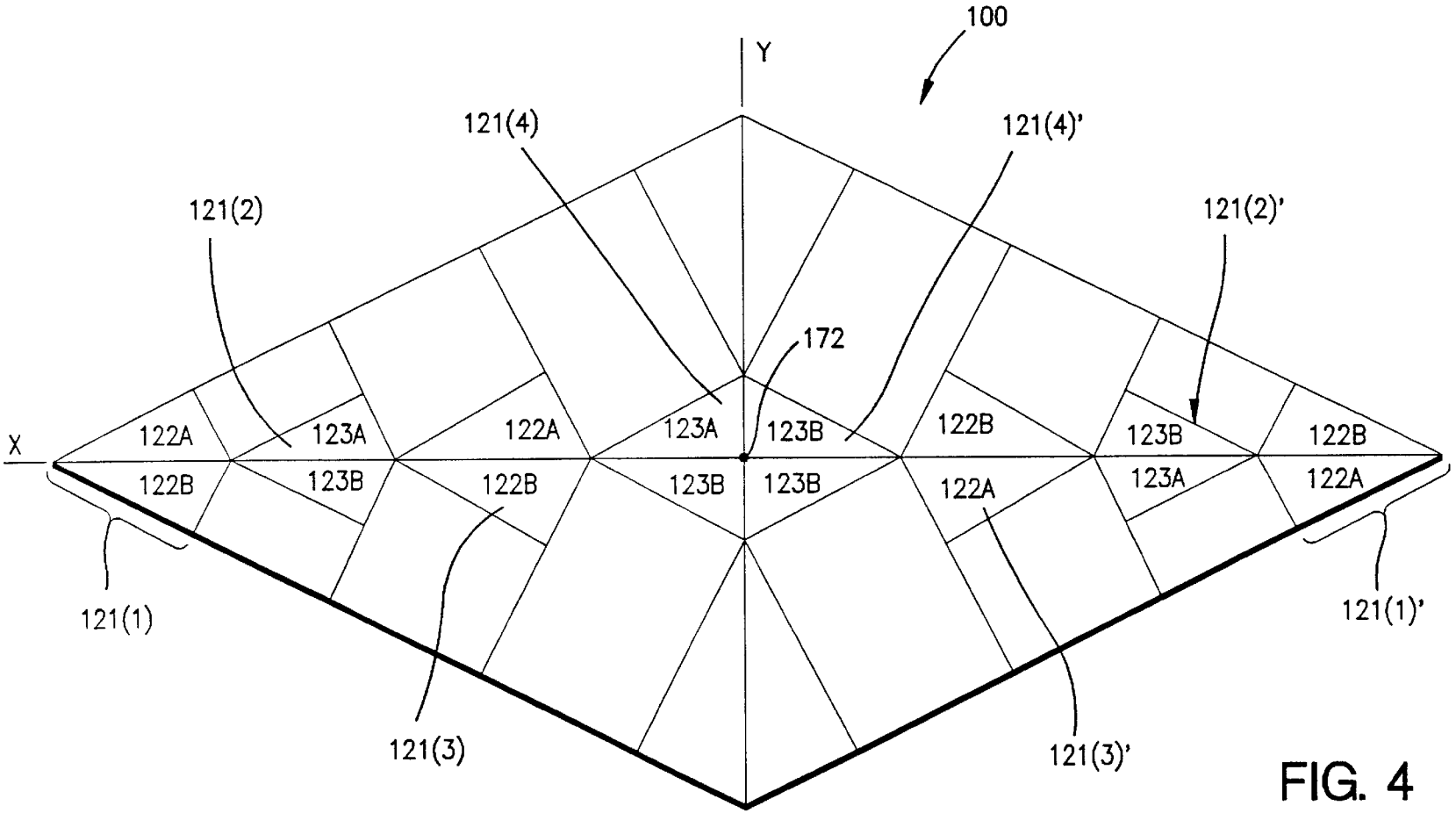
FIG. 4 is a top view of a four stage roofing saddle according to an embodiment of the invention utilizing multiple panel units of FIG. 1.
Figure 6:
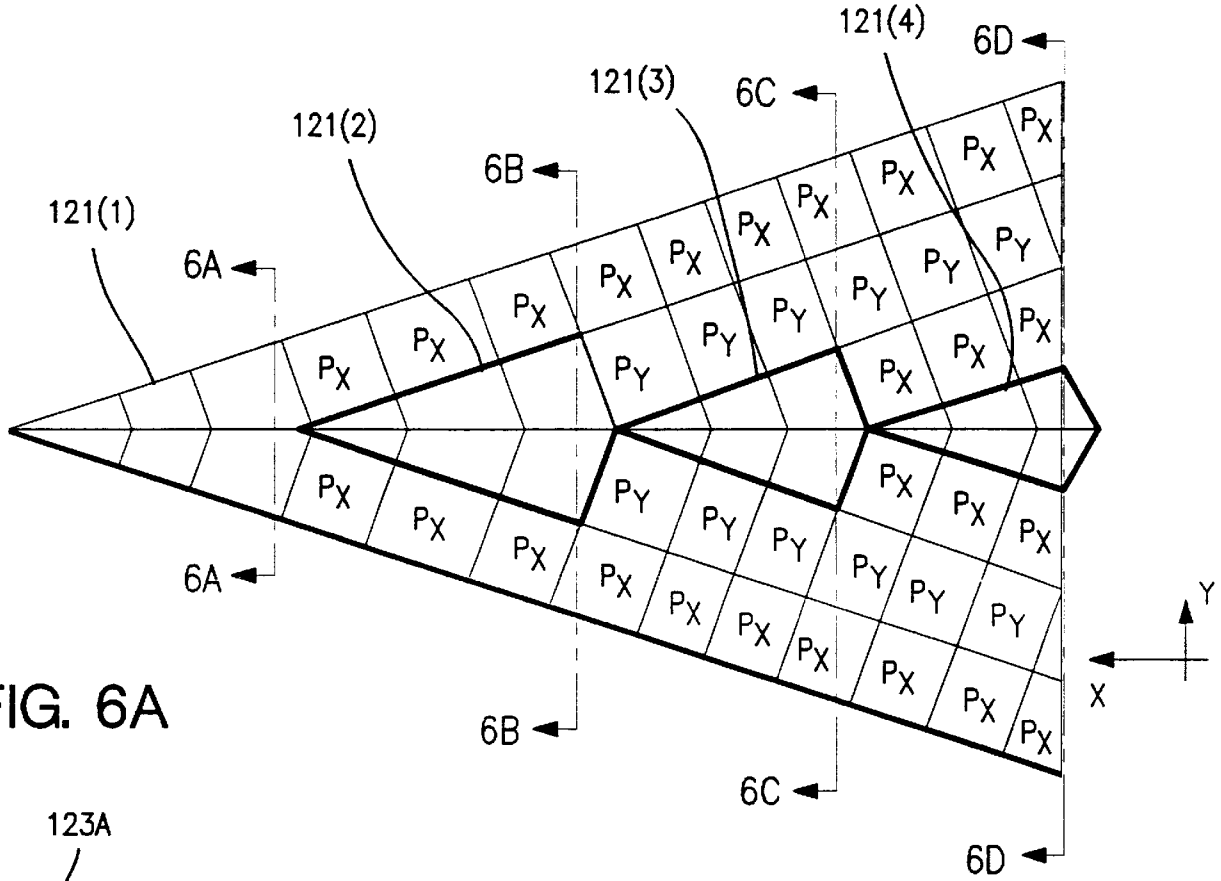
FIG. 6 is a top view showing, in more detail, half of the four stage roofing saddle of FIG. 4.

Moreover, roofing saddles of varying numbers of stages are encompassed by the present invention. For example, FIG. 4 shows a four stage roofing saddle 100 which has eight sets 121(1)–121(4), 121(1)'–121(4)' of panel units. FIG. 6 shows half of the roofing saddle 100 of FIG. 4. Sets 121(1) and 121(1)' form a first stage; sets 121(2) and 121(2)' form a second stage; sets 121(3) and 121(3)' form a third stage; and sets 121(4) and 121(4)' form a fourth stage.

Figure 6A:
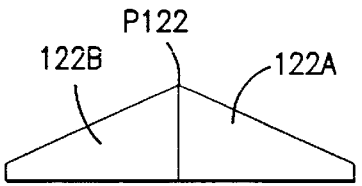
FIG. 6A is a sectional view taken along line 6A—6A of FIG. 6.

Set 121(1) comprises vertically tapering panel units 122A and 122B. Set 121(1)' comprises vertically tapering panel units 122A and 122B which are identical to panel units 122A and 122B, respectively. As shown in FIG. 6A, the panel units 122A and 122B of set 121(1) and 121(1) lie flat on the surface to which the saddle is to be mounted, e.g., on a roofing deck or insulation on the roofing deck.

Set 121(2) and set 121(2)' both comprise vertically tapering panel units 123A and 123B. As understood with reference to FIG. 6B, panel units 123A and 123B have a greater vertical extent (in the Z direction) than do panel units 122A and 122B. In fact, the lowest vertical point P123 on the top surface of panel units 123A and 123B is of the same height as the highest point P122 on the top surface of panel units 122A and 122B (see FIG. 6A and FIG. 6B).

Set 121(3) and set 121(3)' both comprise vertically tapering panel units 122A and 122B stacked upon flat panel units 124A and 124B. The vertically tapering panel units 122A and 122B of sets 121(3) and 121(3)' are identical to same numbered panel units of sets 121(1) and 121(1)'. As shown in FIG. 6C and FIG. 6E, flat panel units 124A and 124B lie flat on the surface to which the saddle is to be mounted, with vertically tapering panel units 122A and 122B positioned thereon. Thus, flat panel units 124A, 124B provide a base upon which the vertically tapering panel units can be stacked. Such a stack, juxtaposed with other panel units, allows an extension of the continuously sloping drainage surfaces of saddle 100 beyond the manufactured thickness of the vertically tapered panel units.

Panel units 122A and 124A are coextensive in the X-Y plane; panel units 122B and 124B are also coextensive in the X-Y plane. Panel units 124A and 124B are, like the other panel units described herein, formed of three panel sections. Moreover, in like manner as with the panel sections of the vertically tapered panel units, the panel sections of panel units 124A and 124B are hinged so that the sections thereof can be fan folded one upon the other. In this regard, FIG. 6E shows hinges 150 and 151 for panel unit 124B. While comparable hinges are also provided for panel unit 124A, for simplicity such hinges are not illustrated in FIG. 6E.

Set 121(4) and set 121(4)' both comprise vertically tapering panel units 123A and 123B stacked upon flat panel units 124A and 124B. The vertically tapering panel units 123A and 123B of sets 121(4) and 121(4)' are identical to same numbered panel units of sets 121(2) and 121(2)'. Moreover, the flat panel units 124A and 124B of sets 121(4) and 121(4)' are identical to same numbered panel units of sets 121(3) and 121(3)'. Again, as shown in FIG. 6D and FIG. 6E, flat panel units 124A and 124B lie flat on the surface to which the saddle is to be mounted, with vertically tapering panel units 123A and 123B positioned thereon.

Thus, in accordance with the present invention, three types of panel units facilitate formation of a four stage saddle 100. The three types of panel units are the lower vertically tapering panel units 122A and 122B; the higher vertically tapering panel units 123A and 123B; and the flat panel units 124A and 124B.

In roofing saddle 100 of FIG. 4 and FIG. 6, only the panel units of sets 122(4) and 122(4)' (and underlying panel units 124) need be modified, in order to form pinnacle 172. Thus, sets 122(1)–122(3) and 122(1)'–122(3)'—all sets except 122(4) and 122(4)'—have the same sized footprint on the roof after installment. The sets 122(4) and 122(4)' have a different footprint in view of its modification.

Figure 5:
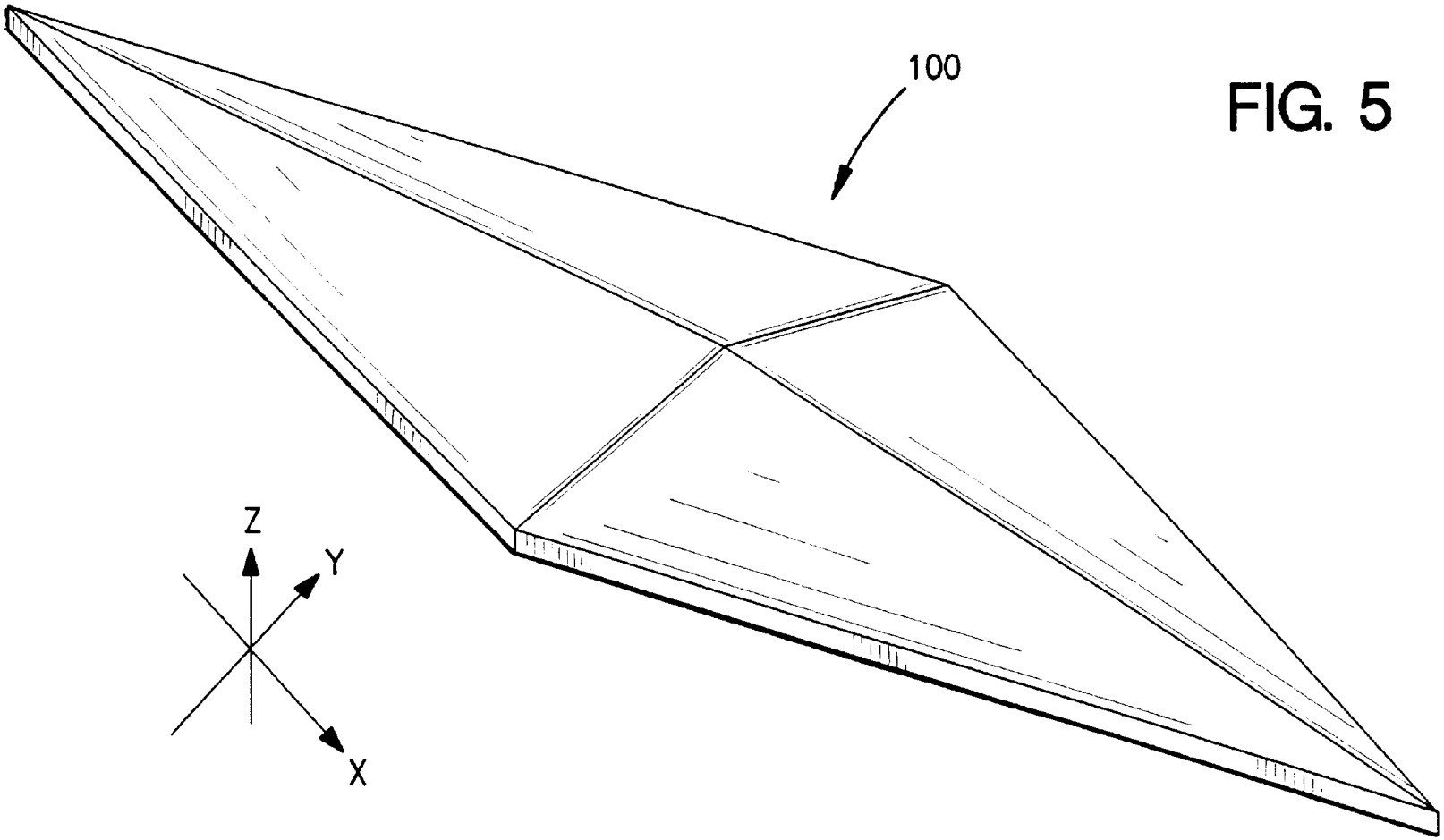
FIG. 5 is a top perspective view of the four stage roofing saddle of FIG. 4 after having been covered with a covering.

As the overall appearance of roofing saddle 100 of FIG. 4 appears as in FIG. 5 when a covering is applied thereover. The covering applied over an installed roofing saddle can be any suitable type, such as a membrane, for example. Suitable membranes include, for example, single ply, built-up membranes, and modified bitumen.

As mentioned above, FIG. 6 shows half of the roofing saddle 100 of FIG. 4, and particularly shows supplemental pieces which can be employed with the present invention. In addition to showing the sets of panel units 122(1)–122(4), FIG. 6 shows how formation of roofing saddle 100 is aided by placement of pre-fabricated supplementary pieces $P_X$, $P_Y$, and $P_F$. Supplementary pieces $P_X$, $P_Y$, and $P_F$ are shown in more detail in FIG. 7. Supplementary pieces $P_X$ and $P_Y$, are vertically tapered, with supplementary pieces $P_X$ being of lower vertical extent than supplementary pieces $P_Y$. Supplementary pieces $P_F$ are flat, and have a vertical extent which is equal to the highest vertical reach of supplementary pieces $P_Y$.

Figure 6B:
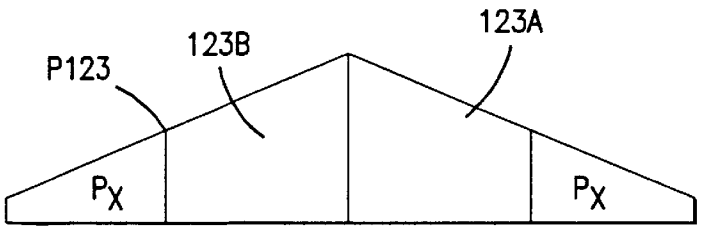
FIG. 6B is a sectional view taken along line 6B—6B of FIG. 6.
Figure 6C:
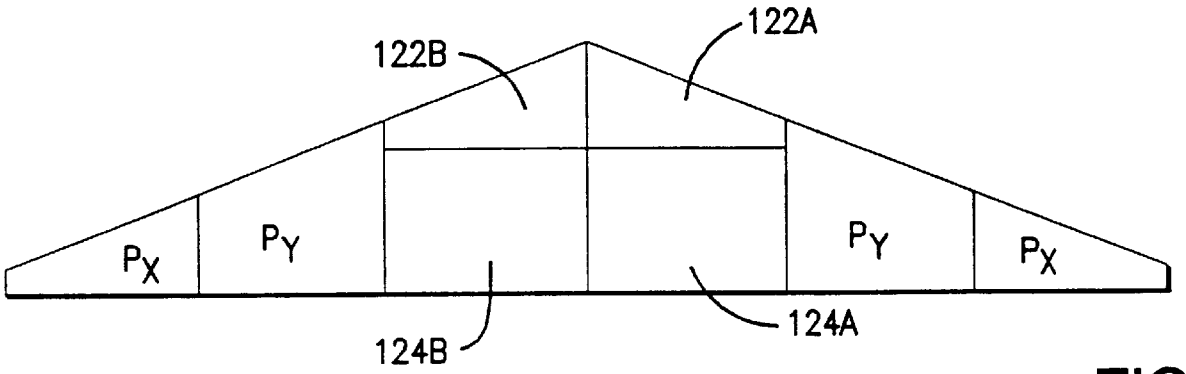
FIG. 6C is a sectional view taken along line 6C—6C of FIG. 6.
Figure 6D:
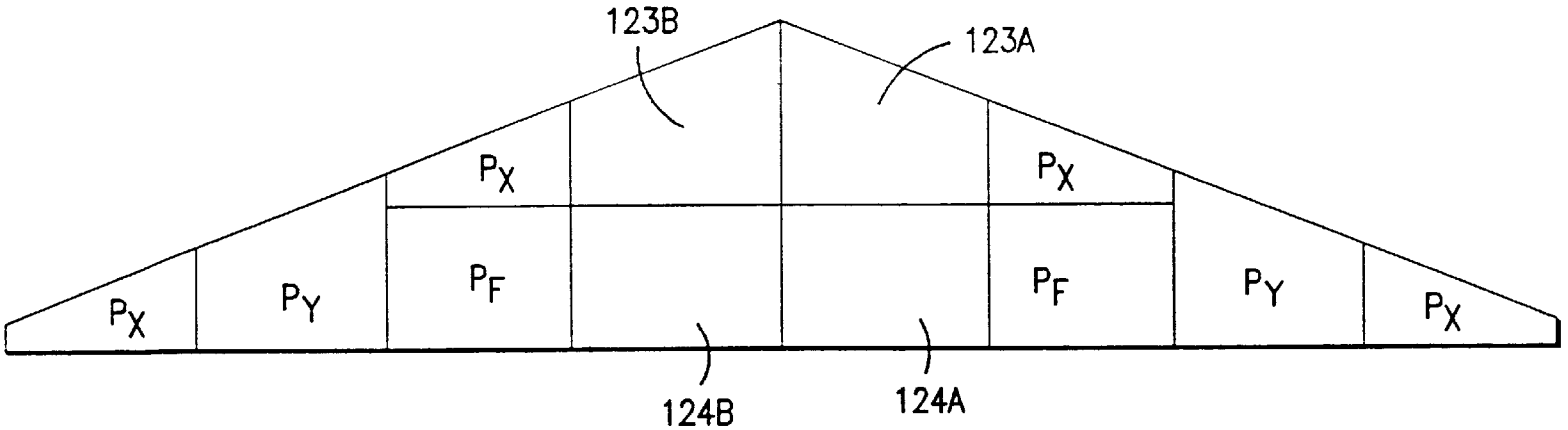
FIG. 6D is a sectional view taken along line 6D—6D of FIG. 6.
Figure 6E:
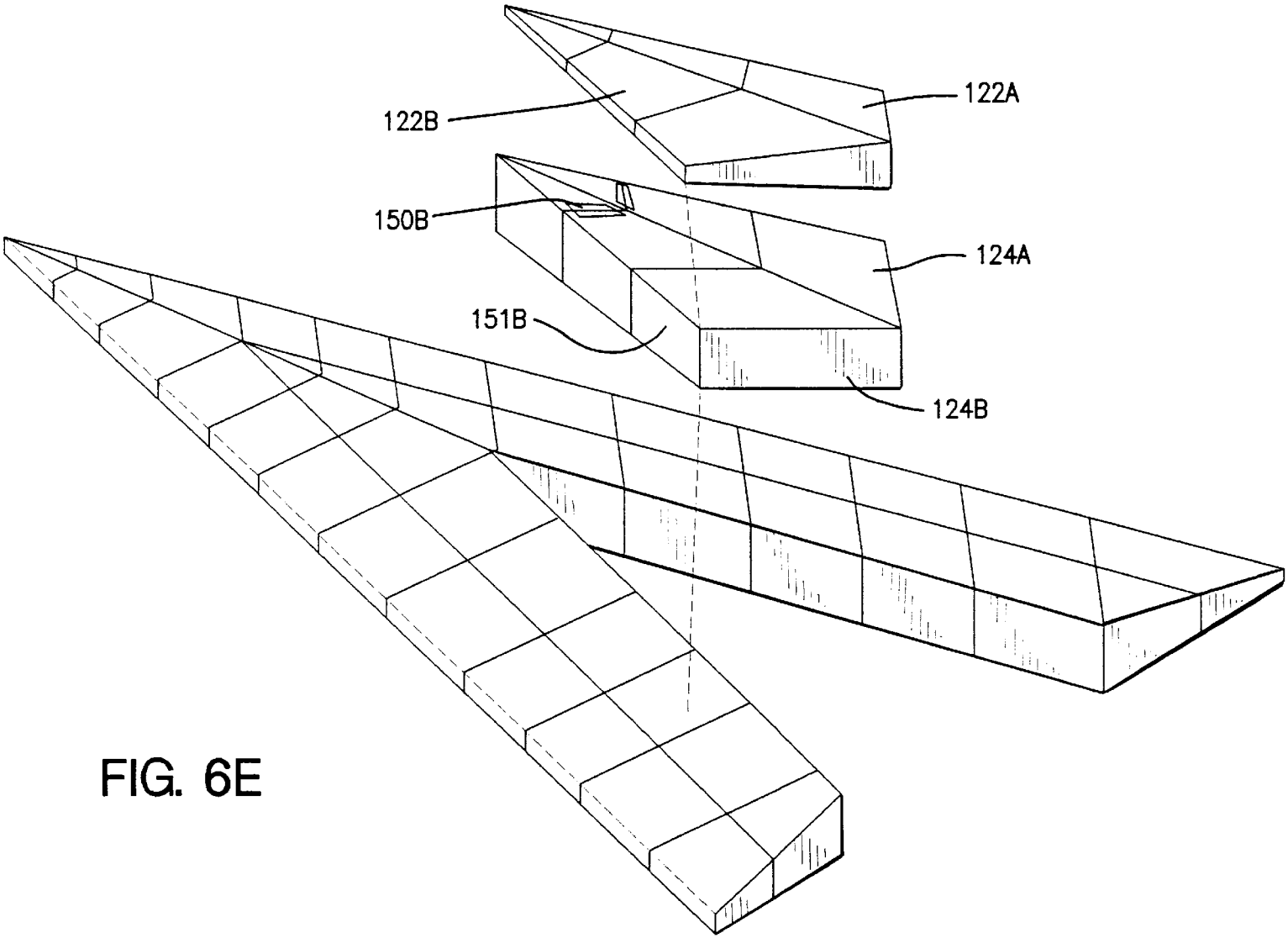
FIG. 6E is an exploded, partially broken away, view of the half saddle of FIG. 6.
Figure 7:
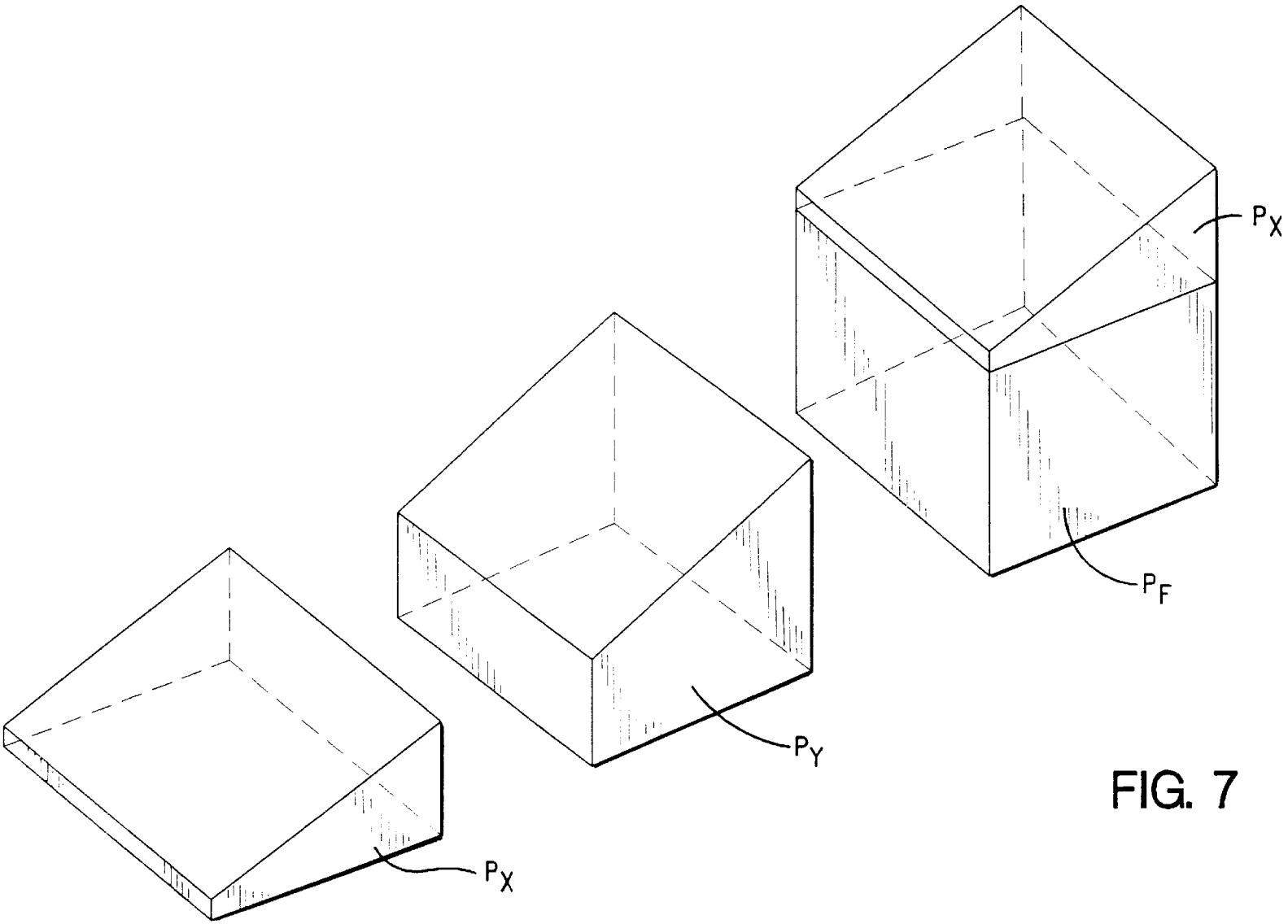
FIG. 7 is a side perspective view of three supplemental pieces utilized in constructing the four stage roofing saddle of FIG. 4.

As understood from FIG. 7, as well as from FIG. 6B, FIG. 6C, and FIG. 6D, supplementary pieces $P_X$ are placed to form the perimeter of the second through fourth stages of saddle 100. In the third and fourth stages the supplementary pieces $P_Y$ are positioned interiorily to abut supplementary pieces $P_X$. In the fourth stage, supplementary pieces $P_F$, which are flat and not tapered, are positioned interiorily to abut supplementary pieces $P_Y$, and are surmounted by supplementary pieces $P_X$.

Figure 8:
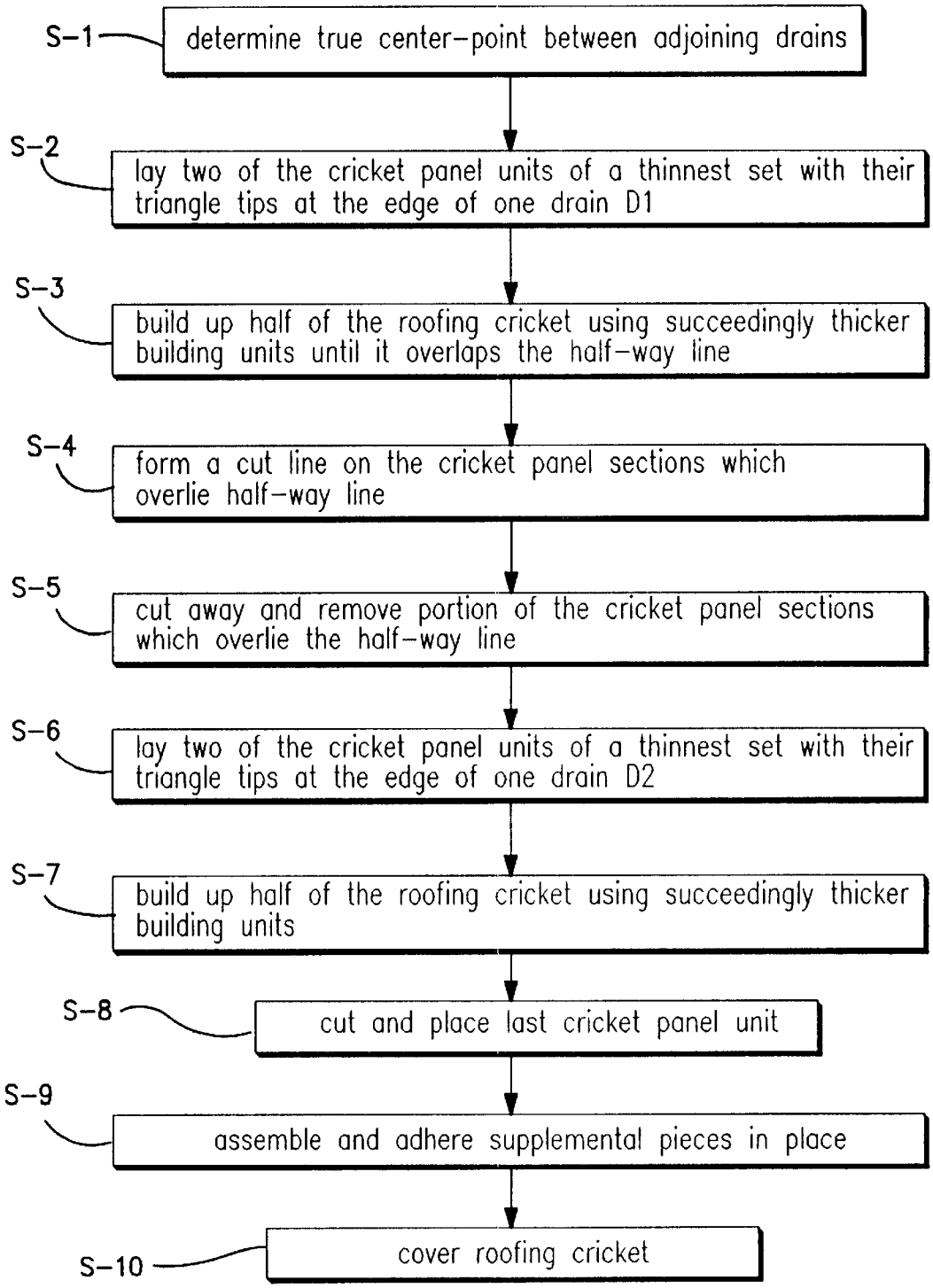
FIG. 8 is a flowchart showing general steps involved in installation of a roofing saddle according to a mode of the invention.
Figure 9:
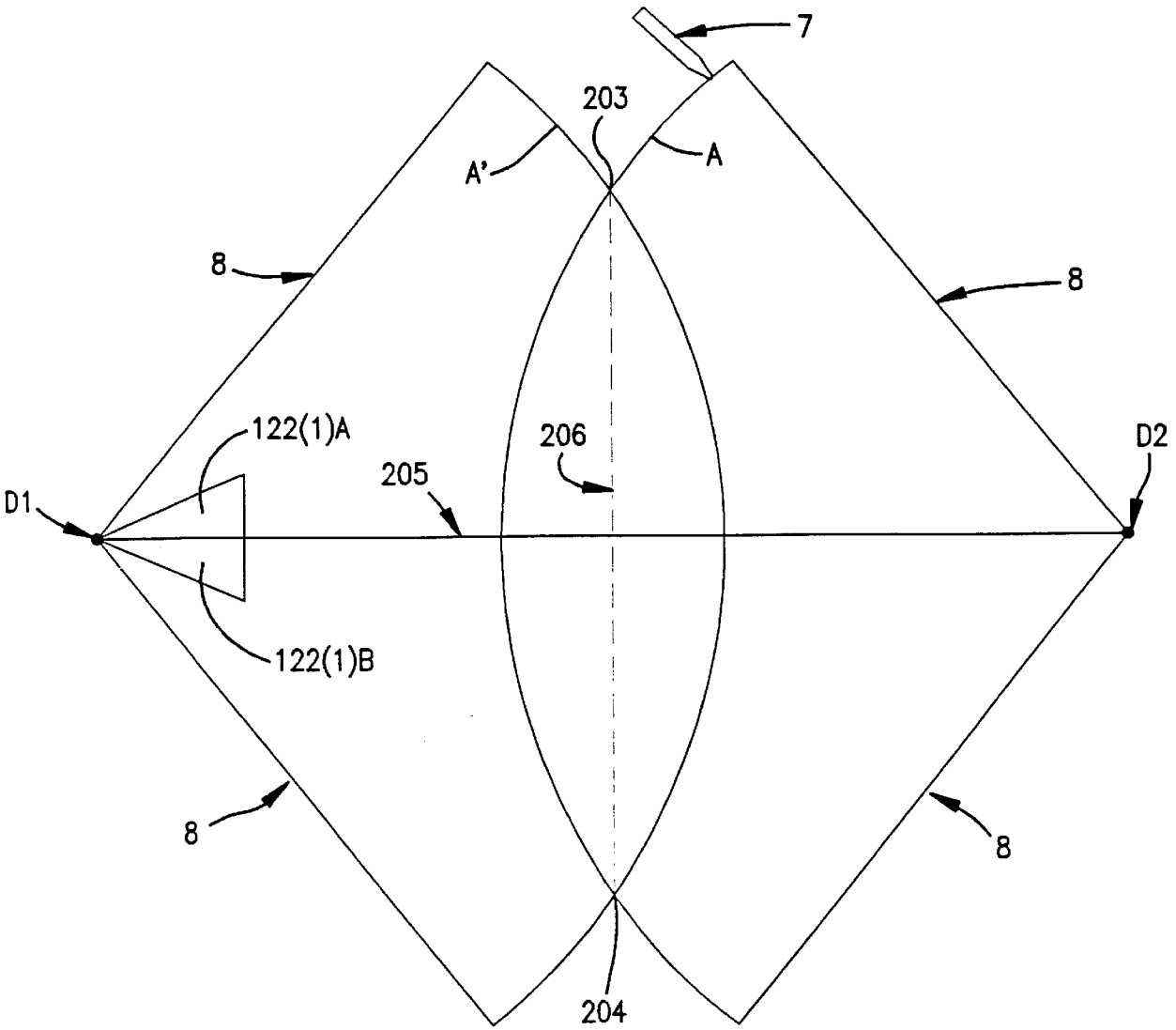
FIG. 9 is a diagrammatic view depicting a flat roof upon which the roofing saddle of the invention is to be installed.

FIG. 8 illustrates general steps involved in installation of a roofing saddle according to a mode of the invention. FIG. 9 depicts a roof area upon which the roofing saddle is to be installed. At step S-1, the true center-point between two adjoining drains (e.g., drains D1 and D2 of FIG. 9) is determined. Such determination can be made, for example, by using a string-compass to find the true center-point between two adjoining drains D1, D2. While one worker holds the string with an attached marking device (chalk, black marker, or crayon) over the center of one drain, the other worker pulls the string to mark the length to the adjacent drain pipe. The line 205 between two adjacent drains is called the "valley". The center of that length of string is found by doubling back the string, placing the end-points together. They then add about two (2) feet to the half-length holding the marking device, and one worker holds that point over the center of each drain in turn while the other worker marks an arc over the valley from each drain. The two arcs A, A' must be large enough that they intersect twice over the valley (at points 203 and 204). Using a chalk-line, the two workers snap a line 206 between the two arc intersections (i.e., between points 203 and 204). This line 206 must be long enough that the full width of the installed saddle does not cover it. This chalk-line 206 is not only the true half-way point, it is perpendicular to the valley line 205 between the drains D1, D2.

Step S-2 of the installation method involves laying two of the panel units of a first (e.g., thinnest) set (e.g., 122(1)) with their triangle tips at the edge of one drain D1 (see FIG. 9). Each panel unit, in folded configuration, is laid on the roof and unfolded in place. Step S-3 involves adding further sets of panel units (e.g., 122(2), 122(3), 122(4)) in increasing order adjacent to the first set 122(1). In other words, at step S-3 half of the roofing saddle is built up using succeedingly thicker building units until it overlaps the half-way line 206. At step S-4, the ends of line 206 which protrude from the laid-down panel sections are used to form a cut line on the panel sections which overlie line 206. The cut line can be formed, for example, by snapping another chalk-line over the saddle at line 206, such that a smooth, straight cut can be made immediately over the half-way line. Using the cut line, the portion of the panel sections which overlie the half-way line are cut away and removed (step S-5).

The other half of the full saddle likewise begins at the edge of the drain D2, with the thinnest set (122(1)) being situated proximate the edge of drain D2 (step S-6). The second half of the roofing saddle is built up half in similar manner as the first half using succeedingly thicker building units (step S-7). However, the last panel unit (e.g., panel sections 122(4)C and 122(4)D of unit 122(4)) is cut to the same length along axis X as was its corresponding unit which overlaid line 106 and then laid in place abutting the vertically flat surfaces of panel sections 122(4)A and 122(4)B [step S-8]. Cutting of panel sections 122(4)C and 122(4)D is accurately performed since the lengths thereof are precisely a mirror-image of the first half (e.g., of panel sections 122(4)A and 122(4)B). Then, at step S-9, the supplemental pieces are assembled and adhered in place. Lastly, the assembled roofing saddle is covered with a membrane or other covering as described above (step S-9).

Figure 10:
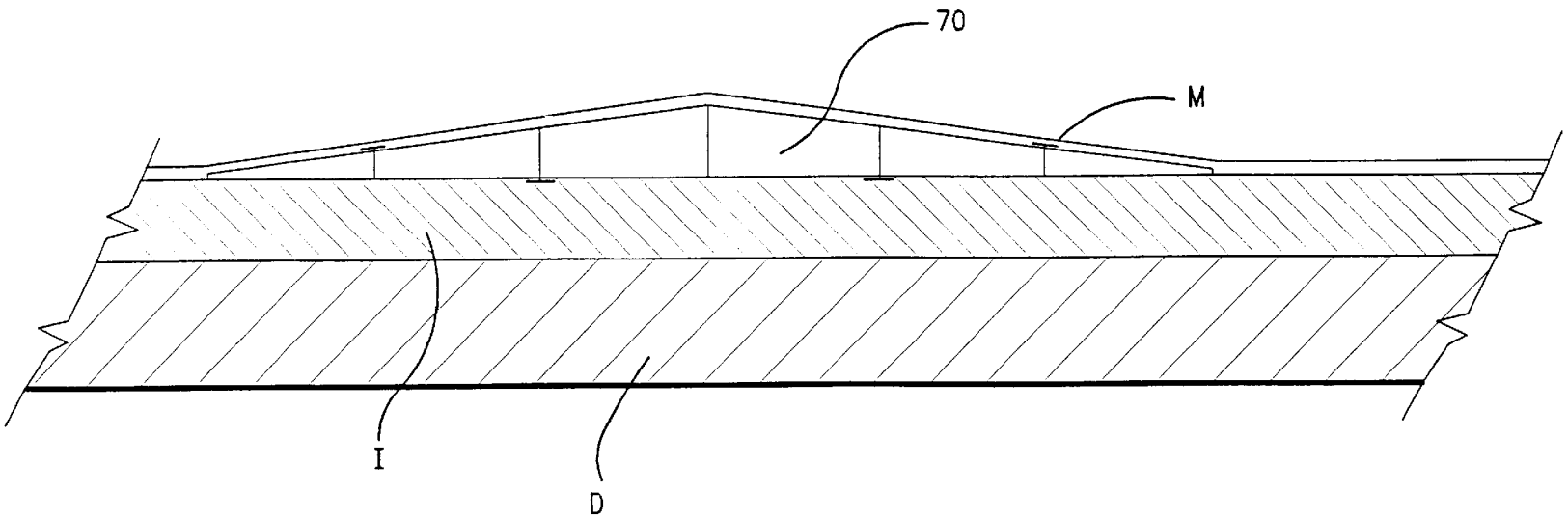
FIG. 10 is a section side view of plural panel units of the invention installed as a saddle upon a roof.

As shown in FIG. 10, the panel units of the present invention lie essentially flat on a roof. For example, FIG. 10 shows installation of cricket 70 of FIG. 3, and particularly shows cricket 70 situated on an insulation substrate I, which is, in turn, situated on structural deck D. Deck D is any one of the decks typically found in commercial construction. Insulation substrate I can be either flat as shown, or slightly sloping. A waterproofing membrane M covers cricket 70 and can be secured or loose laid and ballasted.

The panel units of the present invention can themselves be secured when necessary to an underlying roof deck by various means. Securing of the panel units, either as a cricket or a saddlle, can be accomplished e.g. by mechanical fasteners, hot asphalt, or adhesives, for example.

When necessary to achieve sufficient vertical height, vertically tapering panel units can be employed for progressive stages, in much the manner in which set 121(2) with panel units 123A, 123B succeeds set 121(1) in FIG. 6. Although two vertical heights of panel units are illustrated herein (e.g., panel units 122 and 123), it should be understood that more than two can be utilized. In addition or alternatively, further vertical height can be obtained by stacking vertically tapering panel units on flat panel units, in the manner illustrated, for example, in FIG. 6C and FIG. 6D.

In one mode of production, panel units of the present invention are formed from three linearly arranged boards, each of the boards being formed properly tapered in the Z dimension and having a square shape in the X-Y plane. After the three boards are cut to have the triangle shape shown e.g., in FIG. 1, and excess removed, the remaining portions of the three boards form the respective panel sections 42, 44, and 46 and are connected by hinges 50, 51.

The components of the present invention are very easy to make because they are all cut at the same angle. Unlike the infinite number of angle cuts of the prior art, all panel units of the present invention at the fixed angle of 18.43494882 degrees. Moreover, the basic building unit of the present invention—the panel unit—comprises three pieces hinged together. When completely laid out on the roof, this basic unit forms a triangle having one leg (minor edge) of 48.0-inches, another leg (major edge) of 144.0-inches, and the hypotenuse of 151.7893277 inches. The short leg (minor edge) divided by the long leg (major edge) defines the tangent which, using the above preferred measurements, yields 0.33333333, which is the tangent of the fixed angle used to cut all pieces of the instant invention. Regardless of the thickness (in the Z direction), every panel unit has a right angle (90°) with one edge being 48-inches long, and the other edge 48-inches or shorter.

Each panel unit comprises three panel sections, including: (1) a smallest (1st) piece (e.g., panel section 42B) which is shaped as a true triangle having one leg at 48.0-inches and the other leg at 16.0-inches; (2) a 2nd piece having four sides (e.g., panel section 44B) having the same 16.0-inch side perpendicular to the 48.0-inch edge, plus a 28.0-inch side perpendicular to the 48.0-inch edge; (3) a 3rd piece (e.g., panel section 56B) which has the 28.0-inch side common to the 2nd piece, but the opposite side is a full 48.0-inch edge perpendicular to the 48.0-inch edge. In this manner, the 3rd piece retains most of its area, minimizing waste. The system has every 3rd piece having two sides of maximum length; i.e., 48.0-inches.

Each panel unit 22 has hinge connections at the interfaces of adjoining panel sections. A first hinge 50 is placed on the top surfaces of the $1^{st}$ and 2nd pieces (e.g., at the interface of panel sections 42B and 44B, for example [see FIG. 1]). A second hinge is placed on the bottom surfaces of the 2nd and 3rd pieces (e.g., at the interface of panel sections 44B and 46B, for example). This "fan-fold" arrangement allows the panel sections to be folded together for shipping, then quickly unfolded into place on the roof.

Figure 11A:
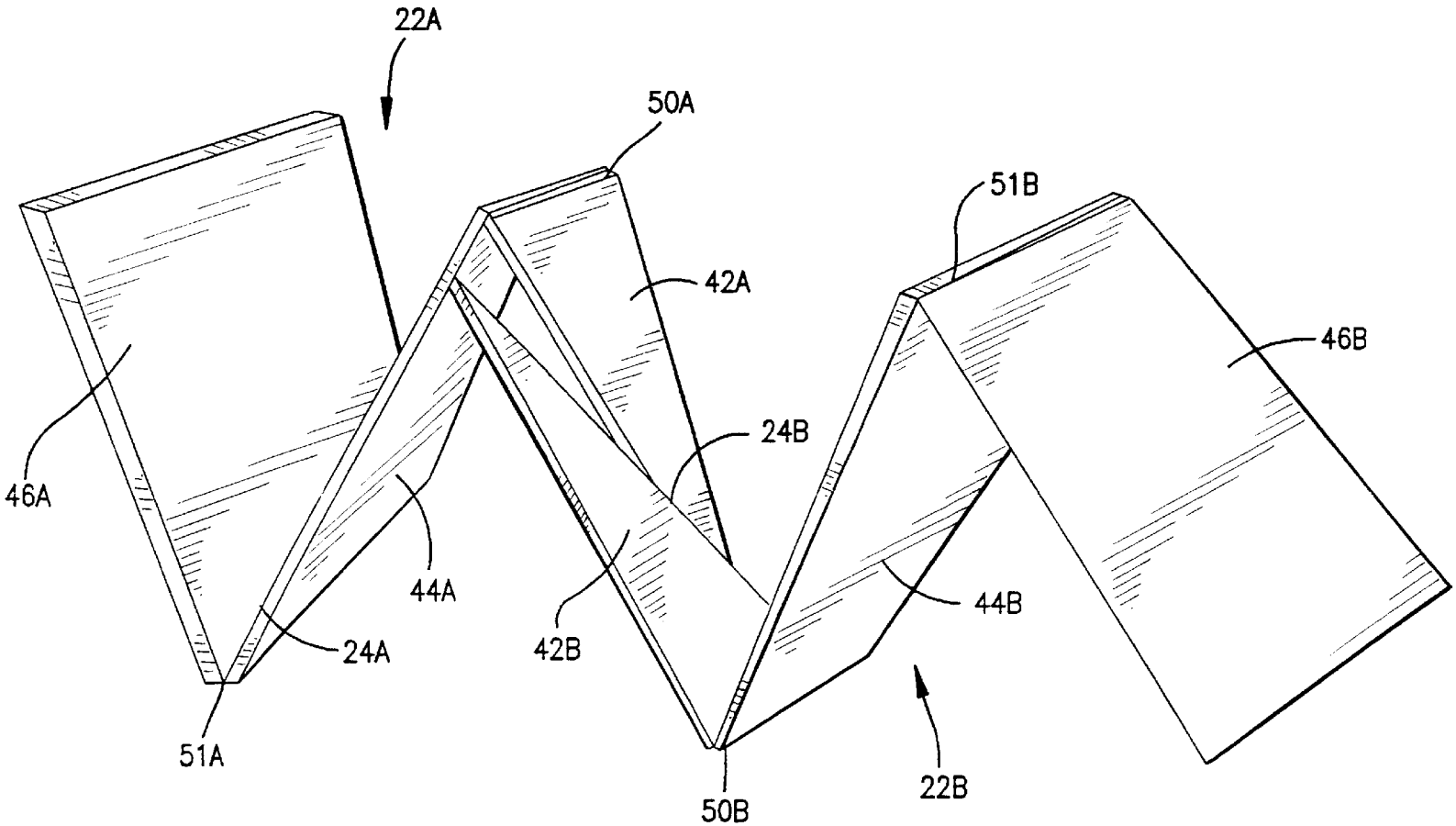
FIG. 11A is a perspective view illustrating folding of two panel units of FIG. 1 into a storage configuration.
Figure 11B:
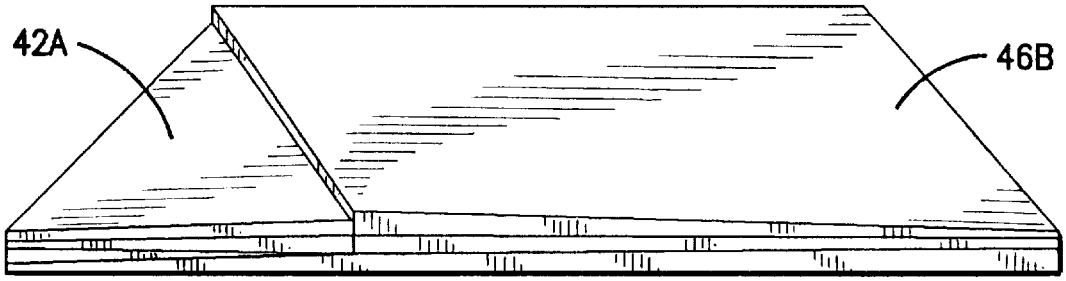
FIG. 11B is a side perspective view of two panel units of FIG. 1 folded into a storage configuration.
Figure 11C:
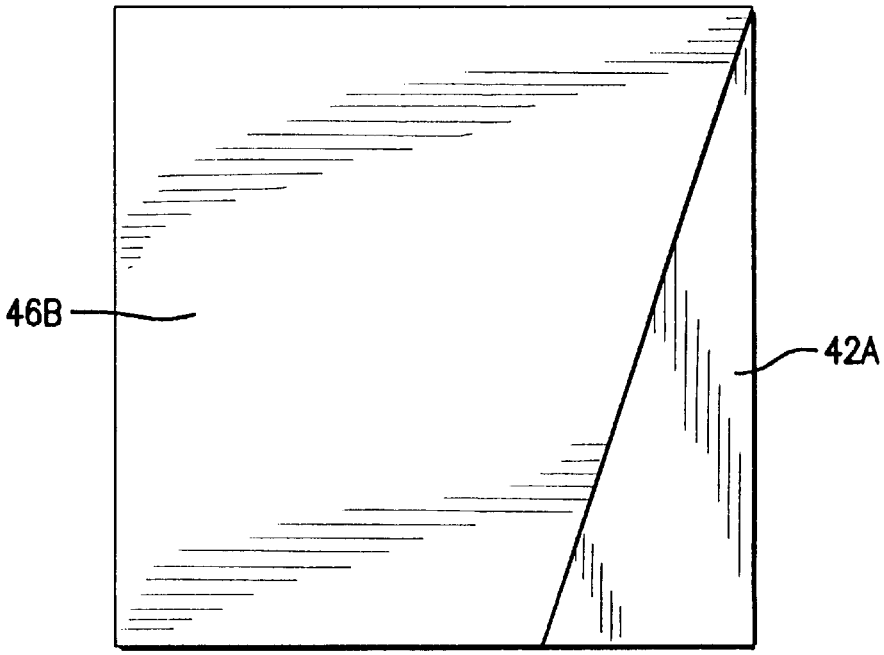
FIG. 11C is a top view of two panel units of FIG. 1 folded into a storage configuration.

FIG. 11A shows two panel units of the present invention in the process of being folded into a storage or transport unit. FIG. 11B and FIG. 11C show the storage or transport unit upon completion of folding of the two panel units into the storage configuration. As appears in FIG. 11A, for panel unit 22A the hinge 51A enables panel section 44A to fold onto panel section 46A, and hinge 50A enables panel section 42A to fold onto panel section 44A. In similar manner, for panel unit 22B the hinge 51A enables panel section 44A to fold onto panel section 46A, and hinge 50A enables panel section 42A to fold onto panel section 44A. The collapsed or folded panel units 22A, 22B are then juxtaposed along their hypotenuse edges 24A, 284, so that panel sections 46A and 42B are lie in a first plane with hypotenuse edges abutting; panel sections 44A and 44B similarly lie in a second plane; and panel sections 42A and 46B similarly lie in a third plane. So configured, panel sections 22A and 22B form a relatively flat stack of three planes of board. As seen from above (FIG. 11C), in each of the three planes the stack is essentially square. The collapsed dual-panel unit stack can then be enveloped (e.g., by shrink wrap) or inserted into a package for transport and storage.

Thus, to facilitate a rugged and compact shipping unit, two of the pre-hinged building units, i.e., panel units, are easily nested next to each other by placing the smallest piece of one unit adjacent to the largest unit of another. When a smallest piece (e.g., panel unit 42B) is placed next to a largest piece (e.g., panel unit 46A), a 48-inch by 48-inch dimension is created, which is also true when two 2nd pieces (e.g., panel unit 44A, 44B) are placed adjacent to each other. To eliminate guessing and searching at the job-site, it may be preferred that only the same thickness building units are packaged together.

The present invention thus provides a simple, low-cost method of manufacturing roof saddles. The saddle installation system of the present invention is also extremely flexible, such that any building construction variances from the drawings can be easily accommodated. Moreover, the present invention also provides an essentially foolproof installation system which can be installed by unskilled labor in a fraction of the time heretofore required.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A three dimensional building construction panel unit comprising:

at least a first panel section and a second panel section, each panel section having a flat bottom surface and a sloped top surface;

the first panel section having a shape of a right triangle when laid on its flat surface, i) said right triangle having three edges of differing length including:

a) a first edge and a second edge of the triangle both having a tapering vertical thickness, and b) a third edge of the triangle having a uniform vertical thickness, and ii) said third edge of uniform thickness being a vertically thinnest portion of said right triangle; and iii) said second edge being perpendicular to said third edge; and a first hinge which connects the first panel to the second panel section, said first hinge connecting said first panel section to said second panel section whereby said second edge of said first panel section abuts said second panel section.

2. The panel unit of claim 1, wherein the panel unit has a triangular shaped flat bottom surface.

3. The panel unit of claim 2, wherein a major edge of the panel unit is substantially forty eight inches long.

4. The panel unit of claim 2, wherein an angle of the triangular shaped flat bottom surface is 18.43494882 degrees.

5. The panel unit of claim 1, wherein the panel unit is formed from one of cellulose fiber board, mineral fiber board, expanded polystyrene board, extruded polystyrene board, and laminated polyisocyanurate board.

6. The panel unit of claim 1, wherein the hinge is formed of a flexible material selected from the group comprised of duct tape, heavy felt, pseudo leather, heavy kraft paper, leather, synthetic fiber tapes and composite tapes.

7. The apparatus of claim 1, wherein the second edge of the first panel section is a shortest edge of the first panel section, and the first edge of the first panel section is a longest edge of the first panel section.

8. The apparatus of claim 1, further comprising:

a third panel section, the third panel section having a flat bottom surface and a sloped top surface;

a second hinge which connects the second panel section to the third panel section.

9. The apparatus of claim 8, wherein the first hinge connects the top surface of the first panel section to the surface of the second panel section;

the second hinge connects the bottom surface of the second panel section to the bottom surface of the third panel section.

10. A three dimensional cricket panel unit situated on a roof, comprising:

at least a first panel section and a second panel section, each panel section having a flat bottom surface and a sloped top surface;

the first panel section having a shape of a right triangle when laid on its flat surface, i) said right triangle having three edges of differing length including:

a) a first edge and a second edge of the triangle both having a tapering vertical thickness, and b) a third edge of the triangle having a uniform vertical thickness, and ii) said third edge of uniform thickness being a vertically thinnest portion of said right triangle; and iii) said second edge being perpendicular to said third edge; and a first hinge which connects the first panel to the second panel section, said first hinge connecting said first panel section to said second panel section whereby said second edge of said first panel section abuts said second panel section.

11. The panel unit of claim 10, wherein the panel unit has a triangular shaped flat bottom surface.

12. The panel unit of claim 11, wherein a major edge of the panel unit is substantially forty eight inches long.

13. The panel unit of claim 11, wherein an angle of the triangular shaped flat bottom surface is 18.43494882 degrees.

14. The panel unit of claim 10, wherein the panel unit is formed from one of cellulose fiber board, mineral fiber board, expanded polystyrene board, extruded polystyrene board, and laminated polyisocyanurate board.

15. The panel unit of claim 10, wherein the panel sections are connected together by a flexible material selected from the group comprised of duct tape, heavy felt, pseudo leather, heavy kraft paper, leather, synthetic fiber tapes and composite tapes.

16. The panel unit of claim 10, wherein the panel unit comprises a third said panel section, wherein a top surface of the first said panel section is connected to a top surface of the second said panel section, and wherein a bottom surface of the second said panel section is connected to a bottom surface of the third said panel section.

17. The apparatus of claim 10, wherein the second edge of the first panel section is a shortest edge of the first panel section, and the first edge of the first panel section is a longest edge of the first panel section.

18. The apparatus of claim 10, further comprising:

a third panel section, the third panel section having a flat bottom surface and a sloped top surface;

a second hinge which connects the second panel section to the third panel section.

19. The apparatus of claim 18, wherein the first hinge connects the top surface of the first panel section to the top surface of the second panel section;

the second hinge connects the bottom surface of the second panel section to the bottom surface of the third panel section.

* * * * *